United States Patent [19]

Iwanami

[11] Patent Number: 4,539,834

[45] Date of Patent: Sep. 10, 1985

[54] ROLLING MILL

[75] Inventor: Toshio Iwanami, Yokohama, Japan

[73] Assignee: Ishikawajima-Harima Jukogyo Kabushiki Kaisha, Japan

[21] Appl. No.: 580,269

[22] Filed: Feb. 15, 1984

[30] Foreign Application Priority Data

Feb. 24, 1983 [JP] Japan ..... 58-26240[U]
Mar. 1, 1983 [JP] Japan ..... 58-29141[U]

[51] Int. Cl.[3] ..... B21B 13/14
[52] U.S. Cl. ..... 72/243; 72/241
[58] Field of Search ..... 72/199, 237, 240, 241, 72/243, 245

[56] References Cited

FOREIGN PATENT DOCUMENTS 171504 10/1982 Japan ..... 72/243

*Primary Examiner*—Lowell A. Larson
*Assistant Examiner*—Jorji M. Griffin

[57] ABSTRACT

A rolling mill is disclosed in which, in order to improve the quality of rolled products, a work roll with a small diameter is used and is offset by a predetermined distance from the reduction line and the horizontal bending force is exerted to the small-diameter work roll through a horizontal intermediate roll from a sectionalized roll so that flatness of a workpiece being rolled is controlled. The small-diameter work roll, the horizontal intermediate roll and the sectionalized roll are so arranged that their axes are maintained in coplanar relationship with each other. Therefore the axes of these rolls can be automatically aligned with a high degree of precision.

7 Claims, 6 Drawing Figures

ROLLING MILL

BACKGROUND OF THE INVENTION

The present invention relates to a rolling mill of the type in which a work roll is offset by a predetermined distance from the reduction line and the horizontal bending force is exerted to the work roll through a horizontal intermediate roll from a sectionalized roll, whereby flatness of a workpiece being rolled can be controlled.

In order to improve the quality of rolled products, work rolls are bent so as to control the flatness of a workpiece being rolled. There has been devised and demonstrated a rolling mill of the type in which a small-diameter work roll is used and is offset by a predetermined distance from the reduction line and the horizontal bending force is exerted to the small-diameter work roll so as to control the flatness of a workpiece being rolled.

A horizontal bending device for exerting the horizontal bending force to the small-diameter work roll as described above comprises in general a horizontal intermediate roll adapted to transmit the horizontal bending force to the small-diameter work roll and a sectionalized roll adapted to exert the bending force to the horizontal intermediate roll. In order to correctly transmit the bending force from the sectionalized roll to the small-diameter work roll, the axes of the small-diameter work roll, horizontal intermediate roll and sectionalized roll must be maintained in coplanar relationship with each other.

The centering or alignment of the axes of the small-diameter work roll, horizontal intermediate roll and sectionalized roll is effected when each of them is assembled into the rolling mill. Alternatively, a small-diameter work roll and a horizontal intermediate roll are assembled as a unitary construction and the alignment of its axis with the axis of the sectionalized roll is effected. As a result, after they have been assembled into the rolling mill and when the rolling mill is operating, the fine alignment of their axes is not made so that the accuracy in alignment is poor. When a small-diameter work roll is ground for re-use, its diameter changes so that the re-alignment is needed. This re-alignment operation is very troublesome. Furthermore, there is a disadvantage that due to the variation in diameter of a small-diameter work roll, the pass line is changed.

DETAILED DESCRIPTION OF THE PREFERRED EMBODIMENTS

Figure 1:
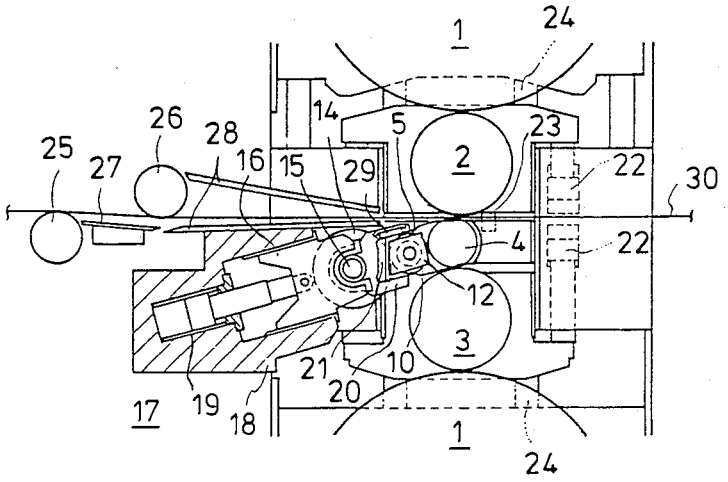
FIG. 1 is a vertical sectional view of a first embodiment of the present invention.
Figure 2:
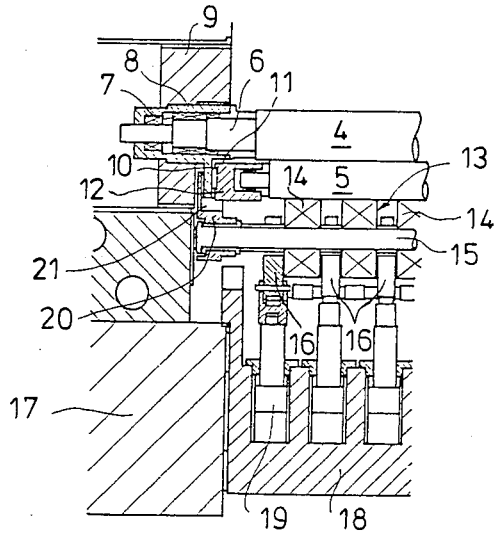
FIG. 2 is a horizontal sectional view thereof.

First Embodiment, FIGS. 1 and 2

In the following embodiments to be described, a lower work roll is smaller in diameter than an upper work roll and is offset in the upstream direction.

Referring to FIGS. 1 and 2, reference numeral 1 designates backup rolls which back up an upper work roll 2 and an intermediate roll 3. A lower work roll (of a small diameter) 4 is interposed between the upper work roll 2 and the intermediate roll 3 and is offset by a predetermined distance in the direction of rolling. A horizontal intermediate roll 5 is made into contact with the lower work roll 4.

A shaft 6 of the lower work roll 4 is supported at its each end through a bearing 7 by a bearing housing 8 which in turn is rotatably fitted into a bearing box 9. An arm 10 is extended in the upstream direction from the bearing housing 8 and is formed with a guide groove 11 extended radially of the lower work roll 4. A bearing block 12 fitted over the bearing of the horizontal intermediate roll 5 is slidably fitted into the guide groove 11.

A sectionalized roll 13 is made into contact with the horizontal intermediate roll 5 so as to exert the horizontal bending force on it. The sectionalized roll 13 comprises a plurality of short cylinder-like rolls 14 mounted rotatably on a shaft 15. Both side surfaces of each roll 14 are supported by sliders 16. The sliders 16 are supported by a beam 18 in such a way that they are slidable in the radial direction of the lower work roll 4. The beam 18 is extended between a pair of housings 17 (one housing is not shown). The sliders 16 are pivoted to piston rods of bending cylinders 19 embedded in the beam 18.

Each end of the shaft 15 is rotatably fitted with a guide lever 20. The guide lever 20 is formed with an engaging groove 21 into which the arm 10 is slidably fitted.

Reference numerals 22, 23 and 24 designate cylinders for exerting vertical loads on the bearing boxes; 25 and 26, guide rolls; 27, 28 and 29, guides; and 30, a workpiece.

Next the mode of operation of the first embodiment will be described.

The bearing blocks 12 are fitted over the bearing housings 8 of the lower work roll 4 so that the lower work roll 4 and the horizontal intermediate roll 5 are unitized in construction and then assembled with the housings 17.

The bearing housing 8 and the guide lever 20 are assembled together and the bending cylinders 19 are energized so that the sectionalized roll 13 is pressed against the horizontal intermediate roll 5. As a result, the horizontal intermediate roll 5 is pressed against the lower work roll 4. The axes of the lower work roll 4, horizontal intermediate roll 5 and sectionalized roll 13 are in coplanar relationship. Because of the sliding movement between the bearing housing 8 and bearing block 12 and the sliding movement between the bearing housing 8 and guide lever 20, the horizontal intermediate roll 5 and the sectionalized roll 13 may have a degree of freedom in the radial direction of the lower work roll 4. In addition, the horizontal intermediate roll 5 and the sectionalized roll 13 may rotate in unison with each other about the axis of the lower work roll 4 so that there exists an automatic centering or alignment capability.

Even when the diameter and offset of the lower work roll 4 vary, the axes of the lower work roll 4, horizontal intermediate roll 5 and sectionalized roll 13 can be aligned.

Figure 3:
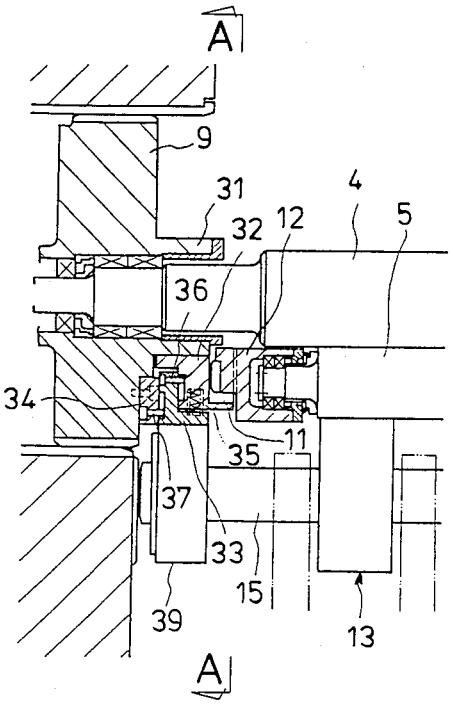
FIG. 3 is a vertical sectional view of a second embodiment of the present invention.
Figure 4:
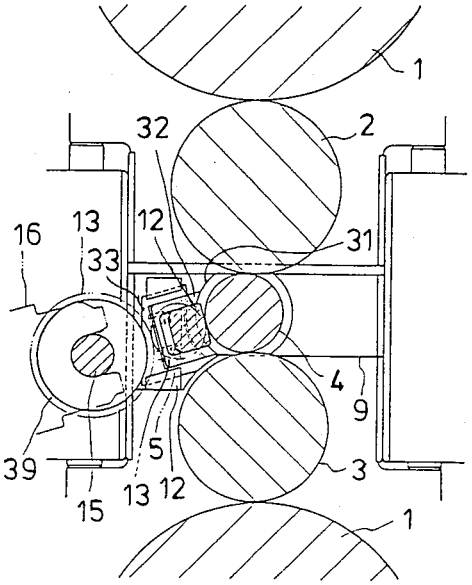
FIG. 4 is a sectional view taken along the line A—A of FIG. 3.

Second Embodiment, FIGS. 3 and 4

A hollow cylindrical portion 31 is extended from the bearing box 9 of the lower work roll 4 coaxially thereof and a guide block 32 whose cylindrical surface is adapted to mate with the cylindrical surface of the cylindrical portion 31 is slidably engaged with the cylindrical portion 31. The guide block 32 is formed with a guide groove 11 extended radially of the lower work roll and a bearing block 12 for supporting the shaft of the horizontal intermediate roll 5 is slidably fitted into the guide groove 11. A floating block 33 is engaged with the guide block 32 in such a way that the floating block 33 can slide in the same direction as the bearing block 12. Moreover, the floating block 33 is mounted through a holding member 34 on the bearing box 9 in such a way that the floating block 33 may slide in the same direction as described above. A spring 35 is loaded between the guide block 32 and the floating block 33 so that the blocks 32 and 33 are biased to be spaced apart from each other. The floating block 33 and the guide block 32 are connected with a pin 36 so that the floating block 33 and the guide block 32 are prevented from separating from each other. In like manner, the bearing box 9 and the floating block 33 are connected with a pin 37 so that they are prevented from separating from each other.

The floating block 33 is formed with a cylindrically recessed portion into which is fitted a guide roll 39 which supports one end of the shaft 15 of the sectionalized roll 13.

The guide block 32 engages with the cylindrical portion 31 and the floating block 33 engages with the guide roll 39. Under these conditions the axes of the lower work roll 4, horizontal intermediate roll 5 and sectionalized roll 13 are in coplanar relationship with each other.

The sectionalized roll 13 serves to transmit the forces produced by the bending cylinders (not shown) to the horizontal intermediate roll 5 as a bending force. Therefore it is so designed and constructed that the bending cylinders can push a plurality of sliding blocks 16 for supporting the shaft 15, independently of each other.

Next the mode of the second embodiment will be described.

The horizontal intermediate roll 5 has a degree of freedom in the radical direction of the lower work roll 4. Since the guide block 32 and the floating block 33 may move toward or away from each other, the sectionalized roll 13 has a freedom so as to move in the same direction as the horizontal intermediate roll 5.

Moreover, when the guide block 32 engages with the cylindrical portion 31 and the floating block 33 and the guide roll 39 engages with each other, the axes of the lower work roll 4, horizontal intermediate roll 5 and sectionalized roll 13 are in coplanar relationship with each other and are maintained in coplanar relationship under the force of the bias spring 35.

As a result, even when the diameter and offset of the lower work roll 4 vary, the automatic centering or alignment of axes becomes possible.

The spring 35 has been described as being used to bias the guide block 32 and the floating block 33 to be spaced apart from each other, but it is to be understood that instead of the spring 35, a rubber or a cylinder may be used. Furthermore, instead of the cylindrical portion or the guide roll, a partial cylinder surface whose center coincides with the axis of the lower work roll or the sectionalized roll may be used. In addition, the bearing box 12 of the horizontal intermediate rolls may be made into engagement with the floating block 33.

Figure 5:
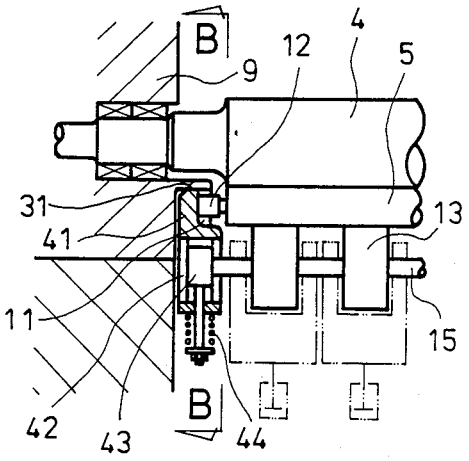
FIG. 5 is a horizontal sectional view of a third embodiment of the present invention.
Figure 6:
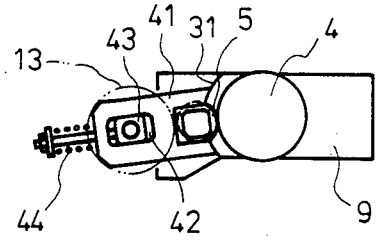
FIG. 6 is a sectional view taken along the line B—B of FIG. 5.

Third Embodiment, FIGS. 5 and 6

The bearing box 9 of the lower work roll 4 is formed with a cylindrical portion 31 which is in coaxial relationship with the lower work roll 4 and a guide arm 41 which has a curved recess adapted to mate with the cylindrical surface of the cylindrical portion 31 is slidably engaged with the cylindrical portion 31. The guide arm 41 is formed with a guide groove 11 extended radially of the lower work roll 4 and the bearing block 12 for supporting the end of the horizontal intermediate roll 5 is slidably fitted into the guide groove 11. The guide arm 41 is further formed with a guide hole 42. A bearing block 43 which is rotatably fitted over the end of the shaft 15 of the sectionalized roll 13 is fitted into the guide hole 42 in such a way that the bearing block 43 may slide in the same direction as the bearing block 12. Reference numeral 44 designates a spring adapted to cause the guide arm 41 to maintain an intimate contact with the cylindrical portion 31.

Thus the guide arm 41 is so designed, constructed and arranged that it may rotate about the axes of the lower work roll 4 and sectionalized roll 13.

Therefore, as is the case of the second embodiment, even when the diameter and offset of the lower work roll 4 vary, the automatic centering or alignment of axes becomes possible.

So far the lower work roll has been described as having a small diameter, but it is to be understood that the upper work roll may have a small diameter or both the upper and lower work rolls have small diameters. Furthermore, the horizontal bending device may be disposed at the downstream of the work rolls.

As described above, according to the present invention the axes of the small-diameter work roll, horizontal intermediate roll and sectionalized roll can be automatically aligned with a high degree of precision. Furthermore, it is not needed to adjust the position of the small-diameter work roll so that there is an excellent advantage that the pass line will not change.

What is claimed is:

1. In a rolling mill of the type in which a work roll is offset by a predetermined distance from a reduction line and a bending force is exerted to the work roll from a sectionalized roll through a horizontal intermediate roll on the offset side of said work roll, whereby flatness of a workpiece is controlled, the improvement which comprises connecting means interposed between each end of a shaft of said work roll and a corresponding end of a shaft of said sectionalized roll, said connecting means being elastic and rotatable about respective axes of said work roll and sectionalized roll, said connecting means supporting said horizontal intermediate roll which is adapted to move in a plane containing the axes of said work roll and sectionalized roll.

2. A rolling mill according to claim 1 wherein a bearing housing for rotatably supporting each end of the shaft of said work roll is disposed rotatably about the axis of said work roll; and said connecting means comprises an arm extended from said bearing housing toward the sectionalized roll and a guide lever rotatably fitted over the shaft of said sectionalized roll, said arm and said guide lever being slidably engaged with each other.

3. A rolling mill according to claim 2 wherein a bearing block for supporting each end of the shaft of the intermediate roll engages with said arm so that said bearing block is slidable with respect to said arm.

4. A rolling mill according to claim 1 wherein said connecting means comprises a guide block and a floating block; said guide block is engaged with a cylindrical surface coaxially disposed on a bearing box of each end of the shaft of said work roll and said floating block is engaged with a cylindrical surface coaxially disposed on each end of the shaft of said sectionalized roll; and said guide block and said floating block are so biased that they are urged to separate from each other.

5. A rolling mill according to claim 4 wherein a bearing block for supporting the intermediate roll is disposed so as to slidably engage with said guide block.

6. A rolling mill according to claim 1 wherein said connecting means comprises a guide arm rotatable about the axis of said sectionalized roll, said guide arm being engaged with a cylindrical surface coaxially disposed on the bearing box of each end of the shaft of said work roll; and said guide arm is biased in an axial direction of said work roll.

7. A rolling mill according to claim 6 wherein a bearing block for supporting each end of the shaft of the intermediate roll is disposed so as to slidably engage with said guide arm.

* * * * *